US006177625B1

(12) United States Patent
Ito et al.

(10) Patent No.: US 6,177,625 B1
(45) Date of Patent: Jan. 23, 2001

(54) APPARATUS AND METHOD FOR GENERATING ADDITIVE NOTES TO COMMANDED NOTES

(75) Inventors: Shinichi Ito; Tsutomu Imaizumi, both of Hamamatsu (JP)

(73) Assignee: Yamaha Corporation (JP)

( * ) Notice: Under 35 U.S.C. 154(b), the term of this patent shall be extended for 0 days.

(21) Appl. No.: 09/516,153

(22) Filed: Mar. 1, 2000

(30) Foreign Application Priority Data

Mar. 1, 1999 (JP) ..... 11-052424

(51) Int. Cl.[7] ..... G10H 1/38; G10H 7/00

(52) U.S. Cl. ..... 84/613; 84/609; 84/610; 84/634; 84/649; 84/650

(58) Field of Search ..... 84/600–602, 609–614, 84/622–626, 634–637, 649–652, 666–669, 659–662

(56) References Cited

U.S. PATENT DOCUMENTS 4,379,422 * 4/1983 Munch et al. ..... 84/661
4,972,753 * 11/1990 Adachi et al. ..... 84/626
5,166,465 * 11/1992 Jeon et al. ..... 84/669
5,214,993 * 6/1993 Konishi ..... 84/637

* cited by examiner

*Primary Examiner*—Jeffrey Donels
*Assistant Examiner*—Marlon T. Fletcher
(74) *Attorney, Agent, or Firm*—Rossi & Associates

(57) ABSTRACT

In accordance with the musical performance by the player, a musical keyboard and an associated processor generate note command signals indicative of note pitches of the tones to be produced in response to which keys are depressed and intensity signals indicative of intensities of the tones to be produced in response to how strong the keys are depressed. A tone generator generates tone signals having pitches and intensities as determined by the note command signals and the intensity signals. A judger judges whether the intensity signals are greater than a predetermined threshold value. When the judgment is affirmative, an additive note designator generates additive note designating signals indicative of note pitches of the tones to be produced in addition to the tones produced as commanded by the depressed key, in which each additive note pitch has a harmonious relation to the corresponding key-commanded note pitch. The tone generator further generates additive tone signals having pitches designated by the additive note designating signals. An alternative detector judges whether the depressed key is a chord constituent note of the chord for the musical performance at that moment.

26 Claims, 5 Drawing Sheets

APPARATUS AND METHOD FOR GENERATING ADDITIVE NOTES TO COMMANDED NOTES

BACKGROUND OF THE INVENTION

1. Field of the Invention

The present invention relates to an apparatus and a method for generating additive notes to commanded notes, and more particularly to a musical apparatus such as an electronic musical instrument capable of generating additive notes in harmony to the melody notes manually played on the keyboard to realize an automatic duet or trio or further polyphonic performance, and to a method conducted in such an apparatus and to a program and data storage medium for use in such an apparatus. Further specifically, the present invention relates to such an apparatus, a method and a storage medium which permit generation of harmony notes when the key touch strength for the melody note is greater than a predetermined threshold value or when the melody note is a constituent note of the accompaniment chord for the melody, thereby realizing a well harmonized polyphonic performance.

2. Description of the Prior Art

Electronic musical instruments capable of generating additive notes are known in the art. In such a conventional electronic musical instrument, when the player depresses an intended key, the instrument generates a musical tone signal as designated by the depressed key and an additive tone signal of a note having a predetermined interval relation (harmonious relation) to the designated musical tone. Under the additive tone generating mode, the apparatus produces additive tones for all the depressed melody keys, respectively.

Such a conventional electronic musical instrument is disadvantageous in the following aspects:

a) An additive tone will be generated in a normal volume even for a weak tone as designated by a weak depression of a key, for example, by some erroneous play on the keyboard, which may cause unintended generation of an additive tone that may not necessarily be harmonious with the played tone. Musical mode or atmosphere may thus be deteriorated by such an unintended bothersome tone.

b) An additive tone will be generated for every tone of the key depression during the performance under the additive tone generation mode, i.e. all the melody tones are accompanied by additive tones, which will be disadvantageous for presenting a musical performance having partial emphasis or a climax by generating additive tones at some intended part or parts in the melody progression.

c) Even in case a chord accompaniment is given to a melody progression, an additive tone will be determined for every tone of the key depression in the melody progression irrespective of the chord progression, and this may cause the generation of additive tones which do not fit the chord under progression thereby deteriorating musical mode or atmosphere.

SUMMARY OF THE INVENTION

It is, therefore, a primary object of the present invention to solve the above-mentioned drawbacks involved in such a conventional electronic musical instrument by providing a novel type of musical apparatus and method for generating additive tones, and a machine readable medium containing a program therefor which are capable of generating additive tones selectively to the melody tones which are to be emphasized in the performance and which are eligible to be accompanied by additive tones from a harmonious point of view.

In order to accomplish the object of the present invention, one aspect of the invention provides a musical apparatus for generating additive notes in addition to commanded notes, the apparatus including: a played note commanding module which generates note command signals indicative of note pitches of played keys in a musical performance; a key intensity representing module which generates key intensity signals indicative of intensities of the played keys; a judging module which judges whether the key intensity signals are greater than a predetermined threshold value; an additive note designating module which generates, upon an affirmative judgment by the judging module, additive note designating signals indicative of note pitches of additive notes to be added to the note pitches of the played keys, each of the note pitches of the additive notes having a predetermined note interval relation to each corresponding one of the note pitches of the played keys; and a tone generator module which generates, upon receipt of the note command signals, tone signals having note pitches as indicated by the note command signals, and upon receipt of the additive note designating signals, tone signals having note pitches as indicated by the additive note designating signals.

In this aspect of the invention, the apparatus may further comprise a musical playing keyboard which includes keys to be depressed for a musical performance, and the played note commanding module may include a first key detector connected to the musical playing keyboard and delivering key data representing pitches of the depressed keys as the note command signals, and the key intensity representing module may include a second key detector connected to the musical playing keyboard and delivering intensity data representing depression intensities of the keys as the key intensity signals. The apparatus may further comprise a storage device which stores performance data representing pitches and intensifies of notes constituting a musical performance, and the played note commanding module may include a pitch data delivery processor which delivers from the storage device the data representing the pitches as the above note command signals, and the key intensity representing module may include an intensity data delivery processor which delivers from the storage device the data representing the intensities as the above key intensity signals. The apparatus may further comprise a receiving module which receives from an external device performance data representing pitches and intensities of notes constituting a musical performance, and the played note commanding module may include a pitch data delivery processor which delivers, upon receipt of the performance data, the data representing the pitches as the note command signals, and the key intensity representing module may include an intensity data delivery processor which delivers, upon receipt of the performance data, the data representing the intensities as the key intensity signals.

According to this aspect of the present invention where a musical playing keyboard and key detectors are provided, the user plays music by depressing intended keys on the keyboard, and then the key detectors delivers note command signals indicative of pitches of the played keys and key intensity signals indicative of intensities of the played keys. The judging module judges whether the key intensity signals are greater than a predetermined threshold value. The additive note designating module generates, upon an affirmative judgment by the judging module, additive note designating signals indicative of note pitches of additive notes to be added to the note pitches of the played keys, wherein each of the note pitches of the additive notes has a predetermined note interval relation to each corresponding one of the note pitches of the played keys. The tone generator module then generates, upon receipt of the note command signals, tone signals having note pitches as indicated by the note command signals, and upon receipt of the additive note designating signals, tone signals having note pitches as indicated by the additive note designating signals. Therefore, when the user touches a key or keys unintentionally, i.e. weakly, no additive tones will be generated. The user may intentionally depress the keys with a key touch greater than the predetermined threshold at any intended portions in the music progression for emphasizing such phrases to selectively generate additive tones at the intended portions, thereby obtaining partial climaxes or emphases in the musical performance.

In order to accomplish the object of the present invention, another aspect of the invention provides a musical apparatus for generating additive notes in addition to commanded notes, the apparatus comprising: a played note commanding module which generates note command signals indicative of note pitches of played keys in a musical performance; a chord designating module which generates chord signals designating chords for the musical performance; a judging module which judges whether each of the note pitches of the played keys is a chord constituent note of the designated chord; an additive note designating module which generates, upon an affirmative judgment by the judging module, additive note designating signals indicative of note pitches of additive notes to be added to the note pitches of the played keys, wherein each of the note pitches of the additive notes has a predetermined note interval relation to each corresponding one of the note pitches of the played keys; and a tone generator module which generates, upon receipt of the note command signals, tone signals having note pitches as indicated by the note command signals, and upon receipt of the additive note designating signals, tone signals having note pitches as indicated by the additive note designating signals.

In this aspect of the invention, the apparatus may further comprise a musical playing keyboard which includes keys to be depressed for a musical performance, and the played note commanding module may include a first key detector connected to the musical playing keyboard and delivering key data representing pitches of the depressed keys as the note command signals, and the chord designating module includes a second key detector connected to the musical playing keyboard and delivering chord data representing chords constituted by the depressed keys as the chord signals. The apparatus may further comprise a storage device which stores performance data representing pitches of notes and chords of accompaniment constituting a musical performance, and wherein the played note commanding module includes a pitch data delivery processor which delivers from the storage device the data representing the pitches as the note command signals, and the chord designating module includes a chord data delivery processor which delivers from said storage device the data representing the chords as the chord signals. The apparatus may further comprise a receiving module which receives from an external device performance data representing pitches of notes and chords of accompaniment constituting a musical performance, and wherein the played note commanding module includes a pitch data delivery processor which delivers, upon receipt of the performance data, the data representing the pitches as the note command signals, and the chord designating module includes a chord data delivery processor which delivers, upon receipt of the performance data, the data representing the chords as the chord signals.

According to this aspect of the present invention where a musical playing keyboard and key detectors are provided, the user plays music by depressing intended keys on the keyboard, and then the key detectors delivers note command signals indicative of pitches of the played keys and chord signals designating chords. The judging module judges whether each of the note pitches of the played keys is a chord constituent note of the designated chord. The additive note designating module generates, upon an affirmative judgment by the judging module, additive note designating signals indicative of note pitches of additive notes to be added to the note pitches of the played keys, wherein each of the note pitches of the additive notes has a predetermined note interval relation to each corresponding one of the note pitches of the played keys. The tone generator module then generates, upon receipt of the note command signals, tone signals having note pitches as indicated by the note command signals, and upon receipt of the additive note designating signals, tone signals having note pitches as indicated by the additive note designating signals. Therefore, additive tones will be generated when the note of the depressed key is a chord constituent note of the designated chord, and no additive tones will be generated when the note of the depressed key is not a chord constituent note of the designated chord, which prohibits generation of additive notes that do not fit the chord progression. In this aspect of the present invention, the additive note designating module may generates pitch signals of one or more of the chord constituent notes of the designated chords as the additive note designating signals. Then the generated additive notes will fit the chord progression very well.

As will be understood from the above description about the apparatus for generating additive notes in addition to commanded notes by generating additive notes when the key depression intensities are greater than a predetermined threshold value or when the depressed keys are chord constituent notes of the designated chords, a sequence of steps each performing the operational function of each of the structural element modules of the above additive note generating apparatus will constitute an inventive method for generating additive notes according to the spirit of the present invention.

Further as will be understood from the above description about the apparatus and the method for generating additive notes, a storage medium containing a program executable by a computer system, which program comprising program modules for executing a sequence of the processes each performing the operational function of each of the structural element modules of the above additive note generating apparatus or performing each of the steps constituting the above additive note generating method will reside within the spirit of the present invention.

Further as will be apparent from the description herein later, some of the structural element modules of the present invention are configured by a computer system performing the assigned functions according to the associated programs. They may of course be hardware structured discrete devices performing the same functions.

The present invention may take form in various components and arrangement of components including hardware and software, and in various steps and arrangement of steps.

The drawings are only for purposes of illustrating a preferred embodiment and processes, and are not to be construed as limiting the invention.

BRIEF DESCRIPTION OF THE DRAWINGS

For a better understanding of the present invention, and to show how the same may be practiced and will work, reference will now be made, by way of example, to the accompanying drawings, in which.

DESCRIPTION OF THE PREFERRED EMBODIMENTS

Figure 1:
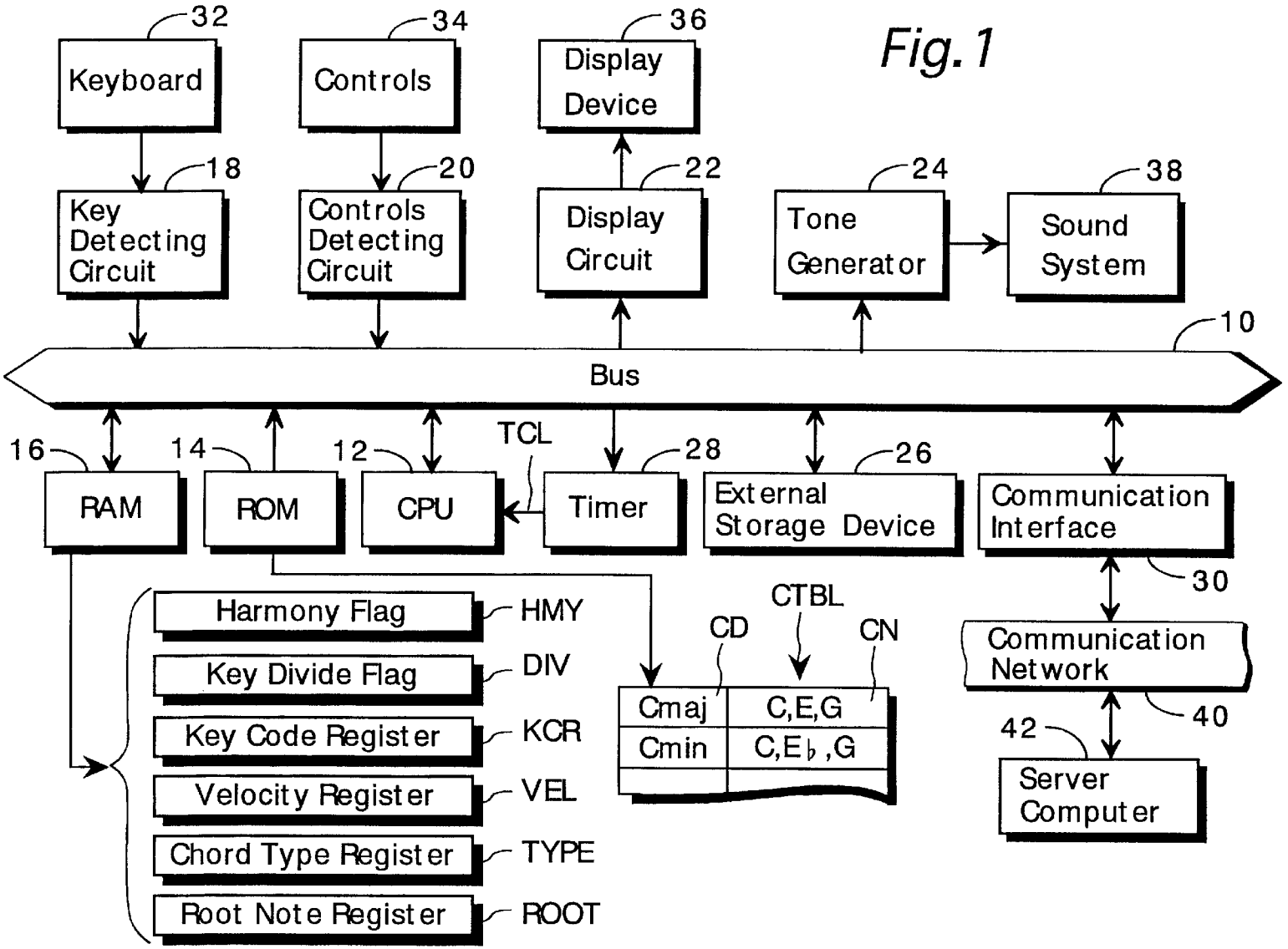
FIG. 1 is a block diagram showing a circuital structure of an example of an electronic musical instrument embodying an additive note generating apparatus according to the present invention.

FIG. 1 is a block diagram showing a circuital structure of an example of an electronic musical instrument equipped with an additive note generating apparatus according to the present invention. The electronic musical instrument is constructed using a small size computer such as a personal computer which controls and performs musical tone generation processing for a manual musical play on a keyboard and an automatic addition of additive notes to the manual musical play according to a computer program.

In this computer associated system, connected to a bus 10 are a CPU (central processing unit) 12, a ROM (read only memory) 14, a RAM (random access memory) 16, a key detecting circuit 18, a controls detecting circuit 20, a display circuit 22, a tone generator 24, an external storage device 26, a timer 28, a communication interface 30, etc. The CPU 12 is to execute various processing for generating tones of the manual music performance notes and of the automatic additive notes according to the programs stored in the ROM 14, which processing will be described hereinafter with reference to FIGS. 2–3*c*. The ROM 14 stores a chord table CTBL in addition to the above-mentioned program. The chord table CTBL includes chord constituent notes CN for each of various chords CD such as Cmaj (a C major chord) and Cmin (a C minor chord). For example, data representing note names C, E, and G is stored for the chord Cmaj.

The RAM 16 includes various storage subdivisions to be used for the respective processes by the CPU 12. Such subdivisions are a memory area HMY for a harmony flag, a memory area DIV for a key divide flag, a memory area KCR for a key code register, a memory area VEL for a velocity register, a memory area TYPE for a chord type register, a memory area ROOT for a root note register, etc. The harmony flag HMY takes a value of either "1" or "0", wherein the value "1" means the harmony addition mode in which harmonious notes are added to the melody notes, while the value "0" means the non-harmony-addition mode. The key divide flag DIV takes a value of either "1" or "0", wherein the value "1" means the key divide mode (or key split mode) in which the keyboard 32 is divided into a melody region and an accompaniment region, while the value "0" means the normal (undivided) mode. The key code register KCR is to store a key code of the depressed key in the keyboard 32. The velocity register VEL is to store a velocity value which represents the key depression velocity (which in turn determines the intensity or volume of the tone to be generated) of the key depressed in the keyboard 32. In other words, the velocity value is the key touch strength. The chord type register TYPE is to store a type (e.g. major) of the chord as established by the keys depressed in the accompaniment region of the keyboard 32 and the root note register ROOT is to store a root note name (e.g. C) of the same chord. The type and the root note of the chord are detected based on the key depression state in the accompaniment region of the keyboard 32 using some known technology in the art.

The key detecting circuit 18 detects the key depression status of the keys in the keyboard 32. The information obtained with respect to the depressed keys includes the key-on event information representing an occurrence of key depression every time a key is depressed, the key code representing which key is depressed, the velocity value representing how strong the key is depressed, the key-off event information representing an occurrence of key release every time a key is released, and the key code representing which key is released. Thus the key detecting circuit 18 serves as the played note commanding module and the key intensity representing module of the present invention. The controls detecting circuit 20 detects the actuation status of the controls 34 (including switches and knobs) arranged, for example in an operation panel of the apparatus. The controls 34 contain a harmony switch and a mode change switch as are necessary for the present invention. The harmony switch is to designate the harmony addition mode, and the mode change switch is to designate either the key divide mode or the normal mode. Also contained may be, for example, key switches in an alphanumeric keyboard for inputting alphabetic characters and numeric characters, and a mouse device for various commanding operations in connection with the display device. The display circuit 22 controls displaying operations of the display device 36 to permit various visual indications on the video screen.

The tone generator 24 contains a plurality of musical tone generating channels for generating various demanded tones. The type or fashion of tone generation may be variously employed from among a wave memory type, an FM synthesis type, a physical model type, a harmonics synthesis type, a formant synthesis type, an analog synthesizer type having VCOs, VCFs and VCAs, and any other types available in the art. The tone generator 24 is not necessarily limited to a hardware structure exclusively functioning as a tone generator, but may be a combination of a DSP (digital signal processor) and a microprogram or a combination of a CPU and a software thereby functioning as a tone generator. The plural tone generating channels may be formed by plural separate (individual) hardware circuits or by a small number of hardware circuit or circuits under a time division multiplexed use. The tone signals from the tone generator 24 are supplied to a sound system 38 to be converted into audible sounds in the atmosphere.

The external storage device 26 may be detachably provided with one or plural types of storage media such as a hard disk (HD), a floppy disk (FD), a compact disk (CD), a digital versatile disk (DVD) and a magneto-optical disk (MO). When the external storage device 26 is equipped with such a storage medium, the data on the medium can be transferred to the RAM 16. Where the equipped storage medium is of a writable type like an HD and an FD, the data in the RAM 16 can be transferred to such a storage medium.

The timer 28 generates a tempo clock signal TCL having a pulse period determined by given tempo data, and supplies the tempo clock signal TCL to the CPU 12 as interrupt requests. The CPU 12 executes an interrupt operation upon receipt of each clock pulse of the tempo clock signal TCL to conduct an automatic music performance based on music performance data stored in the memory such as the ROM 14 and the RAM 16 and/or an automatic accompaniment performance based on accompaniment pattern data stored in the memory.

The communication interface 30 is provided to conduct data communication with a server computer 42 via a communication network 46 such as a LAN (local area network), Internet and a telephone line. Thus, the programs and the various data necessary for the implementation of the present invention can be downloaded from the server computer 42 to the RAM 16 or to the external storage device 26 via the communication network 40 and the communication interface 30 according to a download demand.

The programs may be stored in the storage medium (above-mentioned HD, FD, CD, DVD, MO, etc.) of the external storage device 26 in place of the ROM 14, and may be transferred from the external storage device 26 to the RAM 16 so that the CPU 12 executes the process steps according to the program in the RAM 16. This way of the program storage and transfer will be advantageous in that additions to or upgrading of the program will be easily conducted according to the necessity.

The musical performance may not necessarily be inputted by means of the musical playing keyboard 32, but may be inputted from an external performance apparatus connected via a conventional MIDI interface (not shown) in the form of performance data, and also may be supplied from a storage medium containing such performance data.

Next, with reference to FIG. 2 will be described the outline of an example of the main routine processing for generating additive notes by the CPU 12 and the associated program according to the present invention. This processing starts upon turning on the power switch of the apparatus. A step 50 conducts the initialization for the processing. For example, the flags HMY and DIV are both set with a value "0", and the registers KCR, TYPE and ROOT are all set with a value FF in the hexadecimal notation, meaning no data is stored.

A step 52 judges whether there is an actuation event of the harmony switch among the controls 34 via the controls detecting circuit 20. If the judgment is affirmative (Y), the process moves forward to a step 54 to invert the contents of the flag HMY, i.e. to turn "0" to "1" or to turn "1" to "0". When the judgment at the step 52 is negative (N) or when the process at the step 54 is over, the process moves to a step 56. The step 56 judges whether there is an actuation event of the mode change switch among the controls 34 via the controls detecting circuit 20. If the judgment is affirmative (Y), the process moves forward to a step 58 to invert the contents of the flag DIV, i.e. to turn "0" to "1" or to turn "1" to "0". When the judgment at the step 56 is negative (N) or when the process at the step 58 is over, the process moves to a step 60.

The step 60 judges whether there is a key event in the keyboard 32 via the key detecting circuit 18. If either a key-on event or a key-off event is detected, the step 60 judges affirmative (Y), the process goes to a step 62 to judge whether the key event is a key-on event. If the judgment is affirmative (Y), the process goes to a step 64 to conduct a key depression processing, which will described in detail hereinafter with reference to FIGS. 3*a*–3*c*. When the judgment at the step 62 is negative (N), which means the key event is a key-off event, a step 66 conducts a key release processing. In the key release processing, the key code of the released key and a tone extinction instruction are supplied to the tone generator 24 to start decaying the tone signal of the released key. If an additive tone has also been being generated in this instance, the decay of such an additive tone is concurrently started. When the step 60 judges negative or the process at the step 64 or the step 66 is over, the process proceeds to a step 68 to conduct other processings, including, for example, processing for selecting an addition pattern of the harmony note to the melody note, processing for selecting a musical piece (or a tune) to be automatically performed, processing for selecting an accompaniment pattern to be used for the automatic accompaniment, and processing for starting or stopping the automatic performance or the automatic accompaniment.

Then, a step 70 judges whether there is any actuation for a command of ending the main routine processing, e.g. by turning of the power switch. As long as the judgment is negative (N), the process goes back to the step 52 to repeat the above described process flow. When the judgment at the step 70 turns affirmative (Y), the main routine processing comes to an end.

Figure 2:
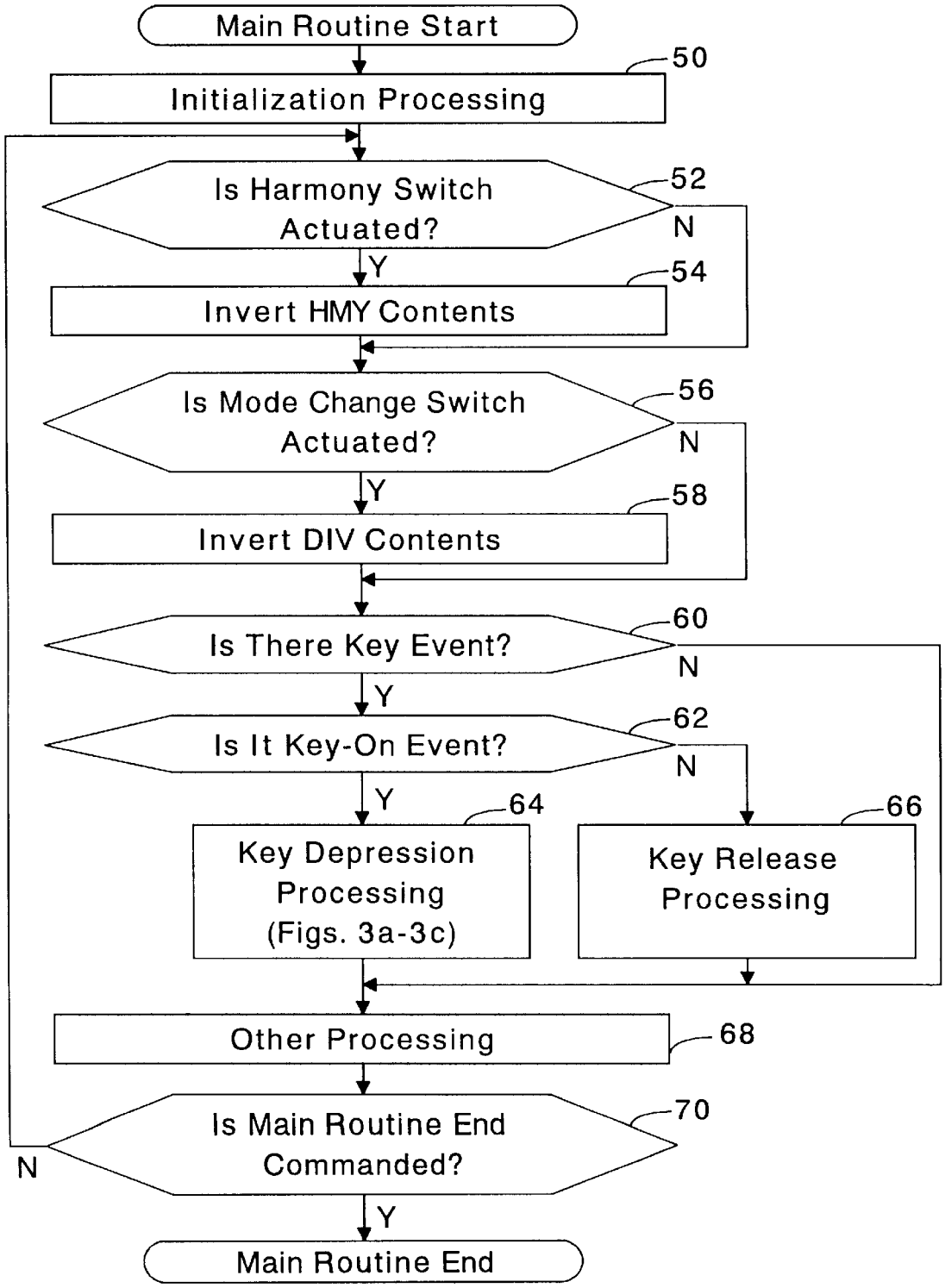
FIG. 2 is a flow chart showing an example of the main routine processing according to the present invention.
Figure 3A:
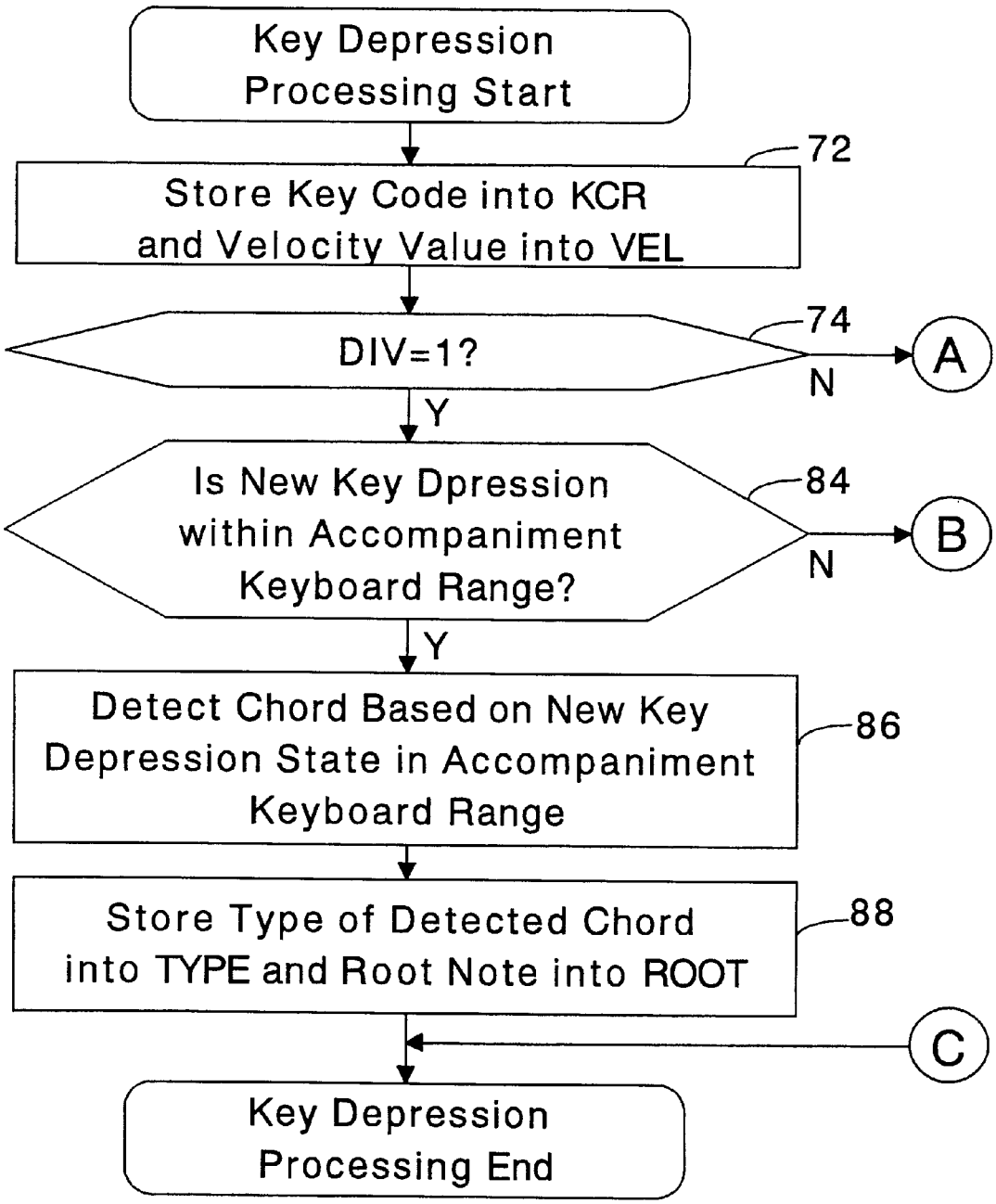
FIGS. 3*a*, 3*b* and 3*b* are, in combination, a flow chart showing an example of key depression processing according to the present invention.
Figure 3B:
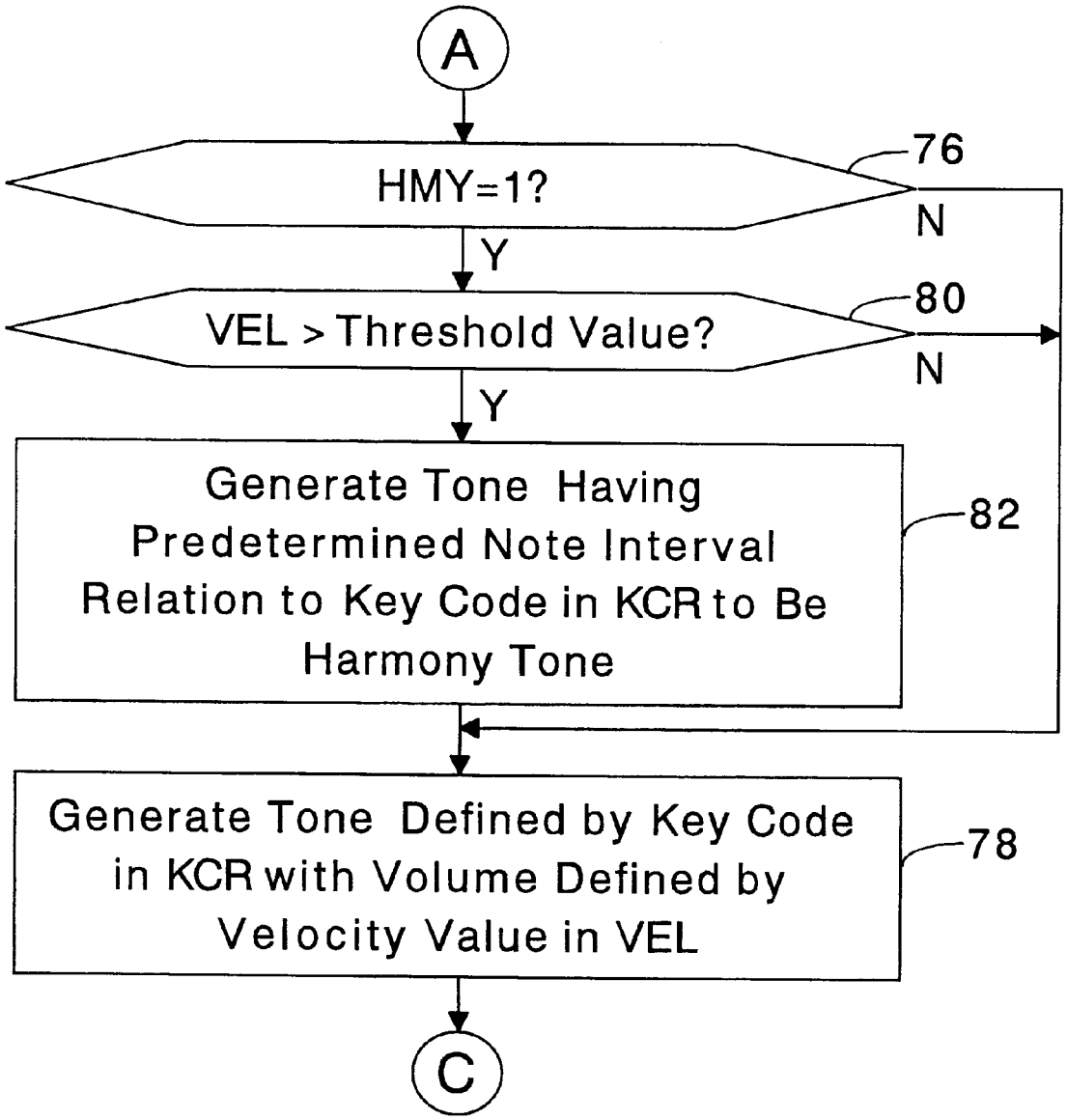
Figure 3C:
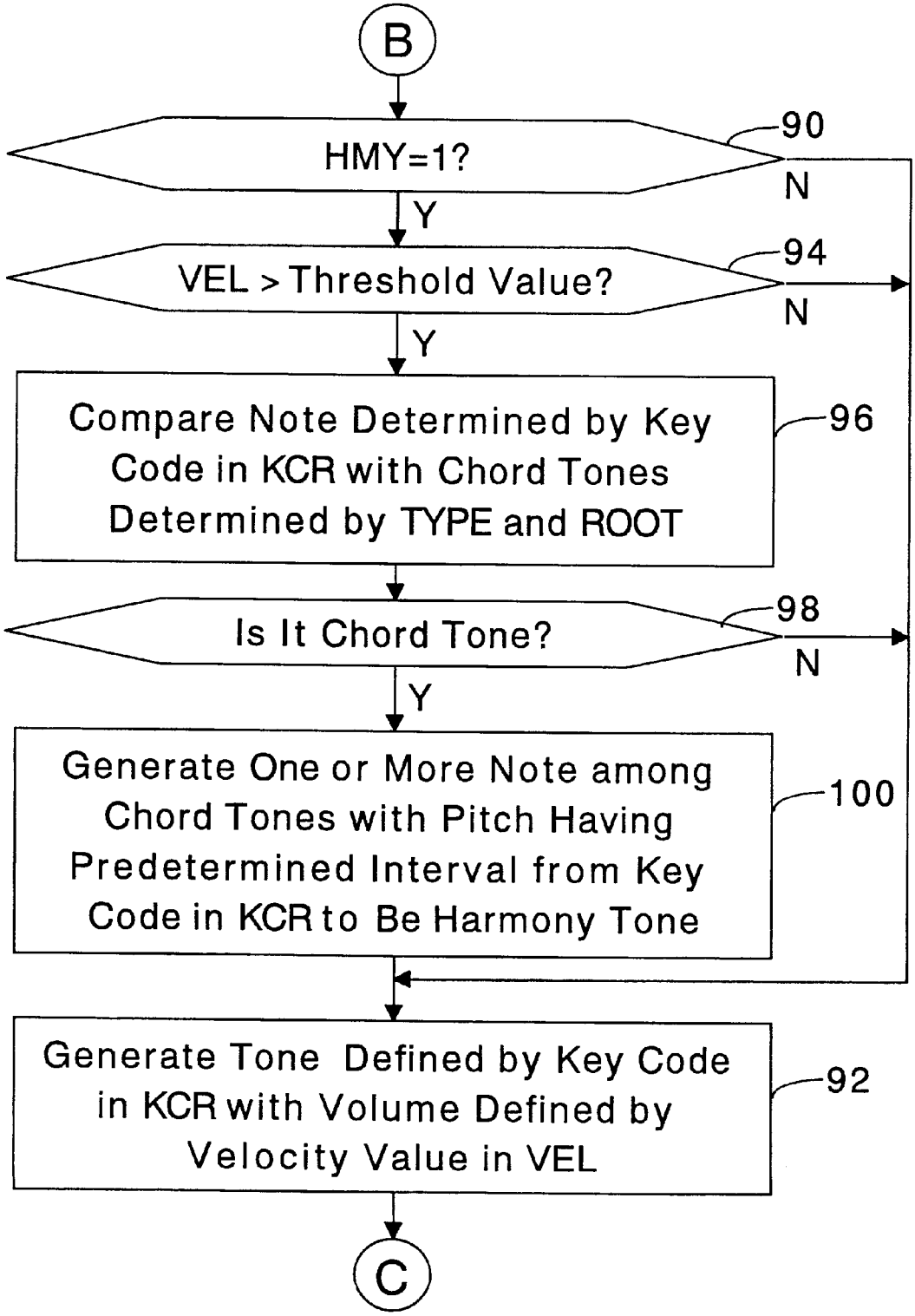

FIGS. 3*a*–3*c* show in combination a flow chart of the key depression processing as conducted at the step 64 in FIG. 2. A step 72 is to store in the register KCR a key code of the depressed key in the keyboard 32 and to store in the register VEL a velocity value detected from the depressed key.

A step 74 judges whether the value in the flag DIV is "1" (meaning a key division mode) or not. If this judgment is negative (N), it means the present mode is the normal mode, and the process flows to a step 74 (FIG. 3*b*). The step 74 judges whether the flag HMY is "1" (meaning a harmony addition mode) or not. If this judgment is negative (N), there is no need of adding a harmony note and therefore the process skips to a step 78 to generate a tone defined by the key code in the register KCR with a volume (intensity) defined by the velocity value in the register VEL. Thus, a harmony note or additive note is not generated in this situation, and only a key-commanded note is generated as in the conventional keyboard performance. After the step 78, the key depression processing comes to an end.

If the judgment at the step 76 is affirmative (Y), it means the present mode is the additive note generation mode, and the process moves to a step 80. The step 80 judges whether the velocity value in the register VEL is greater than a predetermined threshold value. The threshold value is a value previously determined so as not to add an additive note to the regular note of a weakly depressed key. For example, the threshold value is determined at a small intensity level which can be considered as an unintentional depression of a key by mistake so that no harmony note (additive note) should be generated for a key depression exhibiting a smaller intensity than the threshold value (i.e. an unintentional depression by mistake). If the judgment at the step 80 is negative, it means the key depression is an erroneous one, and the process skips to the step 78 to generate a tone defined by the key code in the register KCR with a volume defined by the velocity value in the register VEL. In this case, the velocity value in the register VEL is less than the predetermined threshold value, and therefore no additive tone will be generated in addition to the key-commanded tone. This prevents unintentional and accordingly unnecessary generation of an additive tone in case of an erroneous key depression with a weak key touch. This function is one of the important feature of the present invention.

When the step 80 judges affirmative (Y), the process moves forward to a step 82 to generate a tone which has a predetermined note interval relation to the tone of the key code in the register KCR to be a harmony tone for the key-commanded tone. In order to determine the note pitch which has a predetermined note interval relation to the key-designated note, there may preferably be provided a look-up table indicating suitable additive note pitches for respective key-commanded note pitches or an calculator obtaining additive note pitches according to some predetermined algorithm. Thus determined note pitch indicating signal is supplied to the tone generator 24 together with a tone generation start commanding signal. Then, the step 78 generates a tone defined by the key code in the register KCR with the volume defined by the velocity value in the register VEL as described above. The generation of the harmony tone by the step 82 and the generation of the depressed key tone by the step 78 are executed substantially simultaneously, whereby a harmony tone is added to the depressed-key tone, for example as a duet performance.

According to the above-described harmony addition mode, when the player performs, for example, a melody on the keyboard 32, a harmony tone will not be added to a melody tone (tone of the depressed key) as long as the velocity value of the depressed key does not exceed the predetermined threshold value, but a harmony tone will be added to a melody tone if the velocity value of the depressed key exceeds the threshold value. Utilizing this function, the player can designate the generation of additive tones, i.e. harmony tones at selectively desired portions in the melody progression according to the user's intention.

When the step 74 judges affirmative (Y), it means that the present mode is the key division mode (i.e. key split mode) in which melodies are played by depressing keys in the melody range (usually, the divided right fraction) of the keyboard 32 and chords are played by depressing keys in the accompaniment range (usually, the divided left fraction) of the keyboard 32. Then a step 84 judges whether the newly depressed key is within the accompaniment keyboard range. If this judgment is affirmative (Y), the process moves forward to a step 86 to detect a chord based on the key depression state in the accompaniment keyboard range according to a conventional chord detecting method, i.e. algorithm. The next step 88 is to store data representing the type of the detected chord into the register TYPE and data representing the root note of the detected chord into the register ROOT. Thereafter, the key depression processing is brought to an end.

When the judgment at the step 84 is negative (N), it means that the newly depressed key is within the melody keyboard range, and the process proceeds to a step 90 (FIG. 3*c*) to judge whether the value of the flag HMY is "1" (meaning the harmony addition mode) or not. If this judgment is negative (N), the process skips to a step 92 to generate a tone having a pitch defined by the key code in the register KCR with a tone volume defined by the velocity value in the register VEL. As the present mode is not the harmony addition mode, no harmony tone is added to the generated melody tone. After the step 92, comes an end of the key depression processing.

When the step 90 judges affirmative (Y), it means that the present mode is the harmony addition mode, and the process proceeds to a step 94 to judge whether the velocity value in the register VEL is greater than the threshold value. If this judgment is negative (N), the process skips to the step 92 to simply generate a tone having a pitch defined by the key code in the register KCR with a volume defined by the velocity value in the register VEL, just as described about the step 78. The processing through these steps 94 and 92 corresponds to the processing through the steps 80 and 78, and functions so that no harmony tone should be added to a tone commanded by a weak key depression causing a velocity value less than the threshold value.

When the judgment at the step 94 is affirmative (Y), the process goes forward to a step 96. The step 96 extracts from the chord table CTBL the chord constituent notes of the chord identified by the chord data in the registers TYPE and ROOT, and compares the extracted chord constituent notes with the note name determined by the key code in the register KCR. Next, a step 98 judges whether the above comparison has revealed that the note determined by the key code coincides with a constituent note of the chord extracted from the chord table CTBL (i.e. the depressed key falls on a chord tone). As an example, where the note determined by the key code of the depressed key is "C" and the chord constituent notes extracted from the chord table are C, E and G for the C major chord (Cmaj), the judgment at the step 98 proves affirmative (Y). But, in this case of the C major chord, if the note determined by the depressed key code is F, the judgment at the step 98 turns out to be negative (N).

When the judgment at the step 98 is negative (N), the process skips to the step 92 to generate a tone having a pitch defined by the key code in the register KCR in a tone volume defined by the velocity value in the register VEL, just like in the above described step 78 (FIG. 3*b*). As a result, in case the depressed key does not coincide with any of the chord constituent notes of the chord being played in the accompaniment keyboard range, there will be added no harmony tone to the key-depressed melody tone. This serves to suppress the generation of an additive tone which will not match the prevailing chord progression.

When the judgment at the step 98 is affirmative (Y), the process proceeds to a step 100 to generate one or more of the chord constituent notes of the chord determined by the data in the registers TYPE and ROOT at a pitch having a certain note interval relation to the note determined by the key code in the register KCR to be a harmony tone. For this purpose, the pitch of the tone to be generated as a harmony tone from among the constituent notes of the extracted chord may be determined based on the key code in the register KCR, and then a key code for thus determined tone pitch and a tone generation start signal may be supplied to the tone generator 24. For example, where the chord is a C major chord and the chord constituent notes are C, E and G, and if the key code in the register KCR indicates a C4 note, then the pitch of the harmony tone may be determined as E4 or G4 (for a duet) or both (for a trio).

After the step 100, the process moves to the step 92 to generate a tone defined by the key code in the register KCR with a tone volume defined by the velocity value in the register VEL, as in the case of the step 78 above. The generation of the harmony tone at the step 100 and the generation of the depressed-key tone at the step 92 take place substantially simultaneously to realize the addition of the harmony tone to the playing-key-commanded melody tone.

According to the above-described harmony addition mode under the key division mode, as a melody is played in the melody range of the keyboard 32 and chords are designated in the accompaniment range of the key board 32, the key depression in the melody keyboard range of a melody note which does not fall on a chord constituent note of the chord designated in the accompaniment keyboard range will not cause the generation of a harmony tone to be simultaneously sounded with the melody tone, while the melody key depression which falls on a chord constituent note of the designated chord will cause the generation of a harmony tone or tones to be simultaneously sounded with the melody tone. This will suppress the generation of harmony tones which will not match the chord progression, and permit the generation of harmony tones which will match the chord progression.

As will be apparent for those skilled in the art from the description hereinabove, some of the structural element modules of the present invention are configured by a computer system performing the assigned functions according to the associated programs. They may of course be hardware structured discrete devices. Therefore, a hardware-structured device performing a certain function and a computer-configured module performing the same function should be considered a same-named module or at least an equivalent to each other in the present invention.

While particular embodiments of the invention have been described, it will, of course, be understood by those skilled in the art without departing from the spirit of the present invention so that the invention is not limited thereto, since modifications may be made by those skilled in the art, particularly in light of the foregoing teachings. Such modifications may be, for example, as follows.

(1) The chord table CTBL may be the one which tells chord constituent notes for various types of chords having the root note of C only, as a normalized chord table. For the chords having other root note than C, every constituent note can be calculated by shifting every constituent note of the C-root chord by an amount equal to the difference between the root note C and such another root note.

(2) Addition patterns of the harmony note to the melody note may be variously employed. For example, a pattern may be such that one or two harmony notes are added below (in pitch) a melody note, or may be such that one or two harmony notes are added above (in pitch) a melody note, or may by such that one harmony note is added below a melody note and another harmony note is added above the melody note. One of the above patterns may be fixedly employed, or those patterns may be prepared for selective employment by the user.

(3) Where no chord is designated (or detected) in the accompaniment range under the key division mode (i.e. the case in which both the registers TYPE and ROOT stores a hexadecimal number "FF"), no harmony note had better be added to the melody notes anyway. The flow chart may be so designed.

(4) The threshold value to be used as the comparison reference against the velocity values of the key depressions may be a fixed value or may be variously prepared for the user's selection, or may be arbitrarily set by the user. If the threshold value is determinable by the user, the user can set, according to the user's preference, the key depression strength threshold above which harmony tones should be added to the melody tones so that the user can enjoy a musical performance with emphases which would match the user's intention. The threshold value may be varied along with the progression of the musical performance. For example, where there have occurred several consecutive key depressions having a large velocity value, the threshold value may be changed to a larger value, and where there have occurred several consecutive key depressions having a small velocity value, the threshold value may be changed to a smaller value. This may better fit the overall dynamics (intentional forte/piano variation), avoiding only unintentional key depressions and permitting harmony tone generation both in the generally forte portion and in the generally piano portion of the music progression.

(5) The present invention is of course be applicable not only in an electronic musical instrument having a single keyboard of a dividable use, but in an electronic musical instrument having a melody keyboard and a accompaniment keyboard separately.

(6) The chord data in the registers TYPE and ROOT are not necessarily be derived from a divided accompaniment keyboard range or a separate accompaniment keyboard, but may be derived from an automatic performance device such as a chord sequencer in the form of chord data being read out from the memory according to the progression of the automatic performance.

(7) In case an automatic accompaniment is performed, for example, with chords based on an accompaniment pattern stored in the ROM 14 or the RAM 16, the chord data in the registers TYPE and ROOT are available. In this case, the accompaniment tones will be generated with the pitches determined based on the pitch data read out from the accompaniment pattern. The read-out pitch data may be altered based on the root note data from the register ROOT, and the automatic accompaniment will be conducted with the altered pitch data.

(8) The chord data to be set in the registers TYPE and ROOT may not necessarily be limited to such data as are derived from an accompaniment keyboard (or range) other than a melody keyboard (or range), may be derived by analysis of the overall key depression state in a single or plural keyboards.

(9) In the key release processing at the step 66 under the key division mode (i.e. DIV=1), a new chord may be detected based on the depressed key state after every key release in the accompaniment keyboard range and the chord type data and the root note data of such a newly detected chord may be stored in the registers TYPE and ROOT. In such a case, the harmony tone or tones now being generated may be altered based on the newly stored chord data in the registers TYPE and ROOT.

(10) Although the above described embodiment does not specifically describe how the velocity values (intensity) for the harmony tones are set for the generation of the individual harmony tones, an example may be a manner in which the same velocity values of the depressed-key tone generation are used for the harmony tones, or a manner in which velocity values which are a little bit smaller than the respective velocity values of the corresponding depressed-key tones, or a manner in which velocity values which are a little bit larger than the respective velocity values of the corresponding depressed-key tones, or whatsoever. The above manners of setting the velocity values for the harmony tones may be automatically changed from one to another along with the progression of the musical performance, or may be selected by the user by means of some particular control switch.

(11) The controls 34 may include an alphanumeric keyboard for inputting alphabetic characters or numerals or a mouse device for pointing image boxes on the display screen as in the case of a computer. The harmony switch, the mode change switch and so forth may be software-operated switch boxes on the screen, according to the today's prevailing technology.

According to the present invention therefore, there is provided a judgment module which judges whether the key depression strength is greater than a predetermined value and an additive tone is added to a melody tone only when the judgment module judges that the key depression strength is greater than the predetermined value, and consequently unintentional additive tone generation by mistake will be effectively prevented, which enables the generation of additive tones matching the performed music very well. Even the beginners who are apt to depress the keys erroneously can enjoy a smooth and comfortable performance with harmony tones without being disturbed by non-harmonious additive tones. Further, additive tones are added to the regular key-depressed tones by merely depressing the key stronger than the threshold value, which will lead the performance to a more emphatic one by introducing a particular intended portion of the music progression. Further, there is provided a judgment module which judges whether the key-depressed melody note falls on a chord constituent note as designated by the accompaniment and an additive tone is added to a melody tone only when the judgment module judges that the key-depressed note falls on a chord constituent note, and consequently the generation of additive tones which will not match the chord progression can be avoided effectively, and the generation of additive tones which will match the chord progression will be promoted.

It will be understood that the embodiments shown in the drawings and described above are merely for illustrative purposes, and are not intended to limit the scope of the invention. It is therefore contemplated by the appended claims to cover any such modifications that incorporate those features of these improvements in the true spirit and scope of the invention.

What is claimed is:

1. A musical apparatus for generating additive notes in addition to commanded notes, the apparatus comprising:

a played note commanding module which generates note command signals indicative of note pitches of played keys in a musical performance;

a key intensity representing module which generates key intensity signals indicative of intensities of said played keys;

a judging module which judges whether said key intensity signals are greater than a predetermined threshold value;

an additive note designating module which generates, upon an affirmative judgment by said judging module, additive note designating signals indicative of note pitches of additive notes to be added to said note pitches of said played keys, each of said note pitches of the additive notes having a predetermined note interval relation to each corresponding one of said note pitches of the played keys; and a tone generator module which generates, upon receipt of said note command signals, tone signals having note pitches as indicated by said note command signals, and upon receipt of said additive note designating signals, tone signals having note pitches as indicated by said additive note designating signals.

2. A musical apparatus as claimed in claim 1, further comprising a musical playing keyboard including keys to be depressed for a musical performance, and wherein said played note commanding module includes a first key detector connected to said musical playing keyboard and delivering key data representing pitches of the depressed keys as said note command signals, and said key intensity representing module includes a second key detector connected to said musical playing keyboard and delivering intensity data representing depression intensities of said keys as said key intensity signals.

3. A musical apparatus as claimed in claim 1, further comprising a storage device which stores performance data representing pitches and intensities of notes constituting a musical performance, and wherein said played note commanding module includes a pitch data delivery processor which delivers from said storage device the data representing the pitches as said note command signals, and said key intensity representing module includes an intensity data delivery processor which delivers from said storage device the data representing the intensities as said key intensity signals.

4. A musical apparatus as claimed in claim 1, further comprising a receiving module which receives from an external device performance data representing pitches and intensities of notes constituting a musical performance, and wherein said played note commanding module includes a pitch data delivery processor which delivers, upon receipt of said performance data, the data representing the pitches as said note command signals, and said key intensity representing module includes an intensity data delivery processor which delivers, upon receipt of said performance data, the data representing the intensities as said key intensity signals.

5. A musical apparatus for generating additive notes in addition to commanded notes, the apparatus comprising:

a played note commanding module which generates note command signals indicative of note pitches of played keys in a musical performance;

a chord designating module which generates chord signals designating chords for said musical performance;

a judging module which judges whether each of said note pitches of said played keys is a chord constituent note of said designated chord;

an additive note designating module which generates, upon an affirmative judgment by said judging module, additive note designating signals indicative of note pitches of additive notes to be added to said note pitches of said played keys, each of said note pitches of the additive notes having a predetermined note interval relation to each corresponding one of said note pitches of the played keys; and a tone generator module which generates, upon receipt of said note command signals, tone signals having note pitches as indicated by said note command signals, and upon receipt of said additive note designating signals, tone signals having note pitches as indicated by said additive note designating signals.

6. A musical apparatus as claimed in claim 5, further comprising a musical playing keyboard including keys to be depressed for a musical performance, and wherein said played note commanding module includes a first key detector connected to said musical playing keyboard and delivering key data representing pitches of the depressed keys as said note command signals, and said chord designating module includes a second key detector connected to said musical playing keyboard and delivering chord data representing chords constituted by the depressed keys as said chord signals.

7. A musical apparatus as claimed in claim 5, further comprising a storage device which stores performance data representing pitches of notes and chords of accompaniment constituting a musical performance, and wherein said played note commanding module includes a pitch data delivery processor which delivers from said storage device the data representing the pitches as said note command signals, and said chord designating module includes a chord data delivery processor which delivers from said storage device the data representing the chords as said chord signals.

8. A musical apparatus as claimed in claim 5, further comprising a receiving module which receives from an external device performance data representing pitches of notes and chords of accompaniment constituting a musical performance, and wherein said played note commanding module includes a pitch data delivery processor which delivers, upon receipt of said performance data, the data representing the pitches as said note command signals, and said chord designating module includes a chord data delivery processor which delivers, upon receipt of said performance data, the data representing the chords as said chord signals.

9. A method for generating additive notes in addition to commanded notes using a computer, the method comprising:

a step of generating note command signals indicative of note pitches of played keys in a musical performance;

a step of generating key intensity signals indicative of intensities of said played keys;

a step of judging whether said key intensity signals are greater than a predetermined threshold value;

a step of generating, upon an affirmative judgment by said judging step, additive note designating signals indicative of note pitches of additive notes to be added to said note pitches of said played keys, each of said note pitches of the additive notes having a predetermined note interval relation to each corresponding one of said note pitches of the played keys; and a step of generating, upon receipt of said note command signals, tone signals having note pitches as indicated by said note command signals, and upon receipt of said additive note designating signals, tone signals having note pitches as indicated by said additive note designating signals.

10. A method for generating additive notes in addition to commanded notes using a computer, the method comprising:

a step of generating note command signals indicative of note pitches of played keys in a musical performance;

a step of generating chord signals designating chords for said musical performance;

a step of judging whether each of said note pitches of said played keys is a chord constituent note of said designated chord;

a step of generating, upon an affirmative judgment by said judging step, additive note designating signals indicative of note pitches of additive notes to be added to said note pitches of said played keys, each of said note pitches of the additive notes having a predetermined note interval relation to each corresponding one of said note pitches of the played keys; and a step of generating, upon receipt of said note command signals, tone signals having note pitches as indicated by said note command signals, and upon receipt of said additive note designating signals, tone signals having note pitches as indicated by said additive note designating signals.

11. A storage medium storing a program that is executable by a computer, the program comprising:

a module for generating note command signals indicative of note pitches of played keys in a musical performance;

a module for generating key intensity signals indicative of intensities of said played keys;

a module for judging whether said key intensity signals are greater than a predetermined threshold value;

a module for generating, upon an affirmative judgment by said judging module, additive note designating signals indicative of note pitches of additive notes to be added to said note pitches of said played keys, each of said note pitches of the additive notes having a predetermined note interval relation to each corresponding one of said note pitches of the played keys; and a module for generating, upon receipt of said note command signals, tone signals having note pitches as indicated by said note command signals, and upon receipt of said additive note designating signals, tone signals having note pitches as indicated by said additive note designating signals.

12. A storage medium storing a program that is executable by a computer, the program comprising:

a module for generating note command signals indicative of note pitches of played keys in a musical performance;

a module for generating chord signals designating chords for said musical performance;

a module for judging whether each of said note pitches of said played keys is a chord constituent note of said designated chord;

a module for generating, upon an affirmative judgment by said judging module, additive note designating signals indicative of note pitches of additive notes to be added to said note pitches of said played keys, each of said note pitches of the additive notes having a predetermined note interval relation to each corresponding one of said note pitches of the played keys; and a module for generating, upon receipt of said note command signals, tone signals having note pitches as indicated by said note command signals, and upon receipt of said additive note designating signals, tone signals having note pitches as indicated by said additive note designating signals.

13. A musical apparatus for generating additive notes in addition to commanded notes, the musical apparatus comprising:

an input receiving signals representing note pitches and key intensities of played keys in a musical performance;

a memory storing programs, and a processor coupled to at least said input and said memory, the processor executing various processing in accordance with said programs, wherein said processor is adapted to judge whether said key intensities have predetermined relation to a predetermined threshold value and the processor is also adapted to provide, upon an affirmative judgement thereby, signals representing note pitches of additive notes to be added to said note pitches of said played keys, and wherein said note pitches of the additive notes have predetermined relation to said note pitches of the played keys, wherein said processor controls to generate tone signals having note pitches of said played keys and said additive notes.

14. A musical apparatus as claimed in claim 13, wherein said processor determines said affirmative judgement, when said key intensities are greater than said predetermined threshold value.

15. A musical apparatus as claimed in claim 14, wherein said predetermined threshold value is determined arbitrarily.

16. A musical apparatus as claimed in claim 13, wherein said processor is adapted not to provide, upon a negative judgement thereby, signals representing note pitches of additive notes to be added to said note pitches of said played keys.

17. A musical apparatus as claimed in claim 13, wherein said input has a keyboard which provides said signals representing the note pitches and key intensities of the played keys.

18. A musical apparatus for generating additive notes in addition to commanded notes, the musical apparatus comprising:

a first input receiving signals designating note pitches of played keys in a musical performance;

a second input receiving signals designating chords for the musical performance;

a memory storing programs, and a processor coupled to at least said first input, said second input and said memory, the processor executing various processing in accordance with said programs, wherein said processor is adapted to judge whether said note pitches of said played keys have predetermined relation to said chord, and wherein said processor is also adapted to provide, upon an affirmative judgement thereby, signals designating note pitches of additive notes to be added to said note pitches of said played keys, and wherein said note pitches of the additive notes have predetermined relation to said note pitches of the played keys and said chords, wherein said processor controls to generate tone signals having note pitches of said played keys and said additive notes.

19. A musical apparatus as claimed in claim 18, wherein said predetermined relation to said chord is that each of said note pitches of said played keys is a chord constituent note of corresponding one of said chords, and wherein the predetermined relation is determined using chord constituent information which is stored in said memory.

20. A musical apparatus as claimed in claim 18, wherein each of said note pitches of the additive notes corresponds to a tone pitch of chord constituent notes of said chord.

21. A musical apparatus as claimed in claim 18, wherein said processor is adapted not to provide, upon a negative judgement thereby, signals representing note pitches of additive notes to be added to said note pitches of said played keys.

22. A musical apparatus as claimed in claim 18, wherein a keyboard is comprised as said first and second inputs.

23. A method of generating additive notes in addition to commanded notes in a musical apparatus which comprises an input receiving signals representing note pitches and key intensities of played keys in a musical performance, said method comprising the steps of:

judging whether said key intensities have predetermined relation to a predetermined threshold value;

providing, upon an affirmative judgement on said judging, signals representing note pitches of additive notes to be added to said note pitches of said played keys, wherein said note pitches of the additive notes have predetermined relation to said note pitches of the played keys, and generating tone signals having note pitches of said played keys and said additive notes.

24. A method of generating additive notes in addition to commanded notes in a musical apparatus which comprises a first input receiving signals designating note pitches of played keys in a musical performance and a second input receiving signals designating chords for the musical performance, said method comprising the steps of:

judging whether said note pitches of said played keys have predetermined relation to said chords;

providing, upon an affirmative judgement on said judging, signals designating note pitches of additive notes to be added to said note pitches of said played keys, wherein said note pitches of the additive notes have predetermined relation to said note pitches of the played keys and said chords; and generating tone signals having note pitches of said played keys and said additive notes.

25. A machine-readable recording medium containing a group of instructions of a program for generating additive notes in addition to commanded notes in a musical apparatus to be executed by a processor, said musical apparatus having an input receiving signals representing note pitches and key intensities of played keys in a musical performance, said program comprising the steps of:

judging whether said key intensities have predetermined relation to a predetermined threshold value;

providing, upon an affirmative judgement on said judging, signals representing note pitches of additive notes to be added to said note pitches of said played keys, wherein said note pitches of the additive notes have predetermined relation to said note pitches of the played keys; and generating tone signals having note pitches of said played keys and said additive notes.

26. A machine-readable recording medium containing a group of instructions of a program for generating additive notes in addition to commanded notes in a musical apparatus to be executed by a processor, said musical apparatus having a first input receiving signals designating note pitches of played keys in a musical performance and a second input receiving signals designating chords for the musical performance, said program comprising the steps of:

judging whether said note pitches of said played keys have predetermined relation to said chords;

providing, upon an affirmative judgement on said judging, signals designating note pitches of additive notes to be added to said note pitches of said played keys, wherein said note pitches of the additive notes have predetermined relation to said note pitches of the played keys and said chords; and generating tone signals having note pitches of said played keys and said additive notes.

* * * * *

UNITED STATES PATENT AND TRADEMARK OFFICE

CERTIFICATE OF CORRECTION

PATENT NO. : 6,177,625 B1
DATED : January 23, 2001
INVENTOR(S) : Shinichi Ito et al.

It is certified that error appears in the above-identified patent and that said Letters Patent is hereby corrected as shown below:

Title page,
Item [30], Foreign Application Priority Data, please delete "11-052424" and insert -- 11-052454 --.

Signed and Sealed this

Tenth Day of August, 2004

JON W. DUDAS
*Acting Director of the United States Patent and Trademark Office*